US006808794B1

(12) United States Patent
Mattox

(10) Patent No.: US 6,808,794 B1
(45) Date of Patent: Oct. 26, 2004

(54) PAINT SHIELD

(76) Inventor: Kerry Mattox, 1111 Nature La., Gilbert, SC (US) 29054

( * ) Notice: Subject to any disclaimer, the term of this patent is extended or adjusted under 35 U.S.C. 154(b) by 146 days.

(21) Appl. No.: 10/215,782

(22) Filed: Aug. 10, 2002

Related U.S. Application Data

(60) Provisional application No. 60/311,681, filed on Aug. 10, 2001.

(51) Int. Cl.[7] ..... B05D 7/00

(52) U.S. Cl. ..... 428/220; 428/101; 428/332; 428/337; 428/339; 428/523

(58) Field of Search ..... 428/101, 220, 428/332, 337, 339, 523

(56) References Cited

U.S. PATENT DOCUMENTS 4,559,245 A * 12/1985 Stark ..... 427/282
5,103,762 A * 4/1992 Long et al. ..... 118/504
D416,771 S * 11/1999 Cagle ..... D8/14

* cited by examiner

*Primary Examiner*—Bernard Pianalto
(74) *Attorney, Agent, or Firm*—Leatherwood Walker Todd & Mann, P.C.; Thomas W. Epting

(57) ABSTRACT

A generally T-shaped paint shield formed of a flexible plastic such as high density polyethylene (HDPE). The paint shield includes straight edges of varying and variable lengths to allow it to be used for shielding a variety of surfaces. The paint shield includes left hand and right hand inside corner shields, and left hand and right hand outside corner shields. Preferably, the paint shield includes radiused corners for the left and right hand outside corner shields for accommodating the slight radius typically found on sheet rock, plaster, etc., wall constructions. Because of the inherent flexibility in the paint shield, it can be bent to conform to various wall configurations.

15 Claims, 3 Drawing Sheets

PAINT SHIELD

This application claims benefit of U.S. Provisional application Serial No. 60/311,681, filed Aug. 10, 2001, the entirety of the disclosure of which is incorporated herein by reference thereto.

BACKGROUND OF THE INVENTION

This invention relates to a paint shield used in residential and commercial painting applications, and finds particular use with the application of paint by spraying.

When painting, it is obviously desirable that services which should not receive paint, do not receive paint. For that reason, paint shields have been developed over the years. One form of conventional paint shield includes a metal straight edge to which a handle, which runs generally parallel to the straight edge, is attached. This device is generally rigid, and does not allow for significant flexure for conforming with corners and other angular surface details during painting. Another type of conventional paint shield includes an elongated straight edge portion, having an elongated handle extending generally transversely with respect to the straight edge. However, this design also generally does not offer the flexibility needed for certain surface features.

Another problem with the prior art designs are that they do not offer a large enough shield to provide meaningful protection when paint is applied to a surface by spraying. Overspray from the sprayer must be blocked from application to surfaces which are not to be painted. Since the amount of overspray, and actual overspray area, vary depending on the situation, a significant amount of shielding is required in order to deliver an acceptable paint job.

Accordingly, a need exists for a paint shield which is versatile, flexible, durable, and which provides suitable shielding from paint over spray.

SUMMARY OF THE INVENTION

It is, therefore, an object of the invention to provide paint shield which can be used in a variety of painting applications.

Another object of the present invention is to provide a paint shield for use in spray painting applications.

A further object of the present invention is to provide a paint shield which readily conforms to corners, angles, and other features of surfaces being painted.

Yet another object of the present invention is to provide a paint shield which can be used to accommodate a variety of surface profiles, without requiring to be flipped over.

On the other hand, another object of the present invention is to provide, a paint shield which may be flipped over and continued to be used, if desired.

A further object of the present invention is to provide a paint shield which is lightweight and flexible, and yet sufficiently rigid for paint shielding purposes.

A still further object of the present invention is to provide a method for using a paint shield.

Another object of the present invention is to provide a paint shield which is durable and reusable.

An additional object of the present invention is to provide a paint shield which has a plurality of straight edge shields of variable lengths and inside and outside corner shields.

Another object of the present invention is to provide a paint shield which minimizes marring of freshly painted surfaces.

Generally, the present invention includes a e paint shield formed of a flexible plastic, such as high density polyethylene (HDPE), and which is formed generally in the shape of a T. The shield includes straight edges of varying and of variable lengths to allow the shield to be used for shielding a variety of straight surfaces. The shield also includes left and right hand inside corner shields, and left and right hand outside corner shields. Preferably, the shield includes radiused corners for the left and right hand outside corner shields for accommodating the slight radius typically found on sheet rock, plaster, etc., wall constructions.

The paint shield of the present invention is lightweight and relatively simple to manufacture. It is also durable and relatively easy to use, even for less experienced painters. Because of the flexibility inherent in the paint shield, it can be bent in order to conform to corners, particularly in situations where a small space is involved, such as in a closet, where a wall segment is shorter than the overall length of the desired straight edge.

The paint shield preferably includes a major portion, which has the longest straight edge, and a secondary portion which, together with the major portion, provides numerous hand-hold positions for holding by the painter during use. The secondary portion also provides the shields for left and right hand outside corners to facilitate painting of outside corners. Preferably, the juncture of the secondary portion and the major portion of the shield are radiused in order to improve durability and longevity of the shield by reducing the likelihood of cracks forming and propagating at such juncture.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
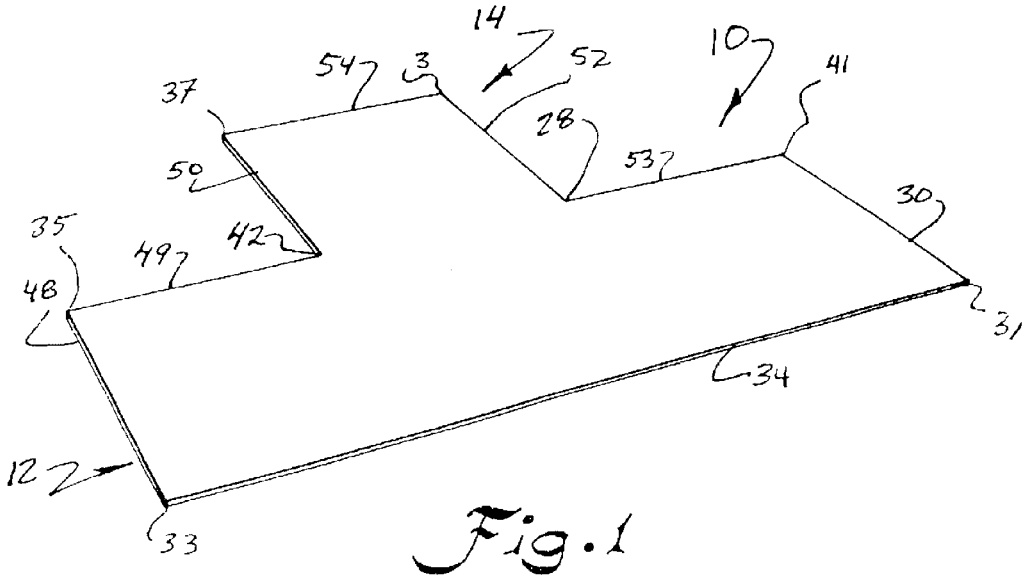
FIG. 1 is a perspective view of a paint shield constructed in accordance with the present invention.

The accompanying drawings and the description which follows set forth this invention in its preferred embodiment. However, it is contemplated that persons generally familiar with painting and paint shields will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the paint shield of the present invention is indicated generally in the figures by reference character 10.

Turning to FIG. 1, paint shield 10 of the present invention is shown. Preferably, paint shield 10 is of a generally T shape and includes a major portion, generally 12, to which a secondary portion, generally 14, is integrally attached. In a preferred embodiment, paint shield 10 is formed from a sheet of high density polyethylene (HDPE) and is made of a thickness which generally provides sufficient rigidity for use as a paint shield, while maintaining the flexibility to allow the shield to be bent drastically (at least about ninety degrees) along the length of major portion 12. In a preferred embodiment, the thickness of shield 10 is approximately $3/32^{nd}$ to $1/8^{th}$ inches. It is to be understood, however, that the shield 10 of the present invention is not limited to HDPE, and could be constructed of a variety of other materials.

Figure 4:
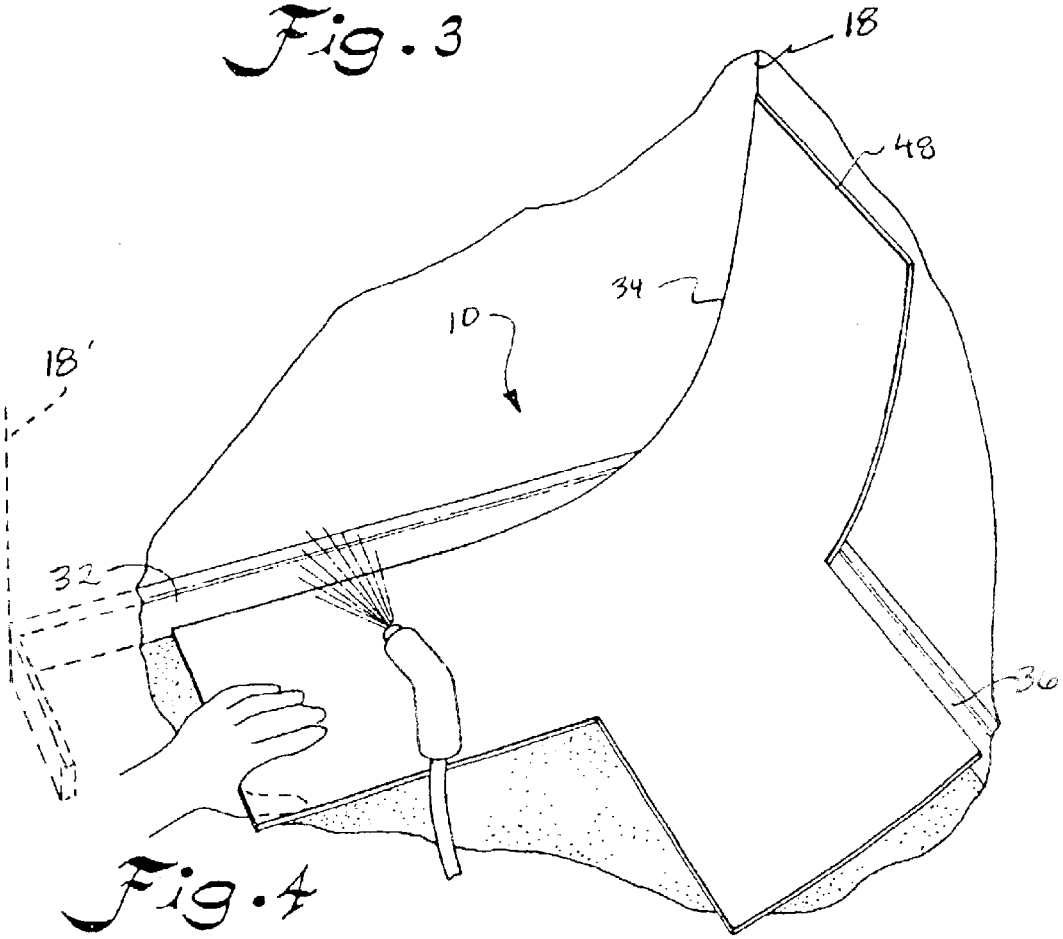
FIG. 4 is a perspective view of a paint shield constructed in accordance with the present invention, bent to conform to a small space and a inside corner thereof.

Shield 10 is flexible, and is bendable to allow it to conform to a corner, such as corner 18 shown in FIG. 4, during painting. This feature of shield 10 finds particular use in small areas, such as closets, alcoves, etc., where a corner 18' prevents shield 10 from laying flat. A slight radius 19 (FIG. 5) is provided at the juncture of major portion 12 and secondary portion 14 to improve durability of the shield, and to reduce crack formation and propagation at such juncture and to closely accommodate the slight radius generally found on wall and other surface coverings.

Figure 2:
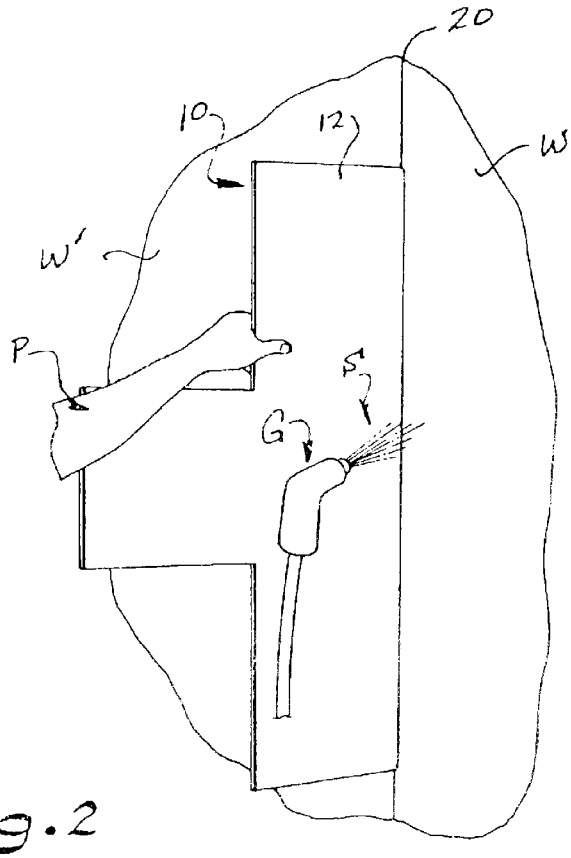
FIG. 2 is a perspective view of a paint shield constructed in accordance with the present invention, in use on a vertical wall surface.

Turning to FIG. 2, shield 10 is shown being used by the painter, generally P, and painting a vertical wall, generally W, surface, at the juncture, or corner, 20 of wall W with wall W'. The paint spray, generally S, emitted from gun, generally G, is directed against wall W, but blocked by major portion 12 of shield 10 from deposit on wall W'. In this instance, shield 10 is being held in a corner, generally 20.

Because of the length of major portion 12, which is 36 inches in one preferred embodiment, the painter is able to paint several feet of wall W at a time before being required to reposition shield 10. It should also be noted from FIG. 2 the location at which the painter is grasping shield 10. Specifically, the painter is grasping left-hand outside corner shield 28, while in FIG. 4, the painter is grasping an outside edge 30 of shield 10. It should be noted in the FIG. 4 illustration that shield 10 could be forced further downwardly into corner 18 by the painter using his or her hand or foot in order to conform shield 10 even more closely to corner 18. This having been done, paint may be applied nearly up to corner 18.

After paint has been applied to baseboard trim 32 as close as possible to corner 18 in the FIG. 4 illustration, the shield 10 could then be removed, and repositioned such that end 30 of shield 10 abuts trim piece 32 and such that straight edge 34 of major portion 12 abuts trim piece 36. This would allow the painter to complete the painting of the wall and baseboard trim of corner 1B.

Figure 3:
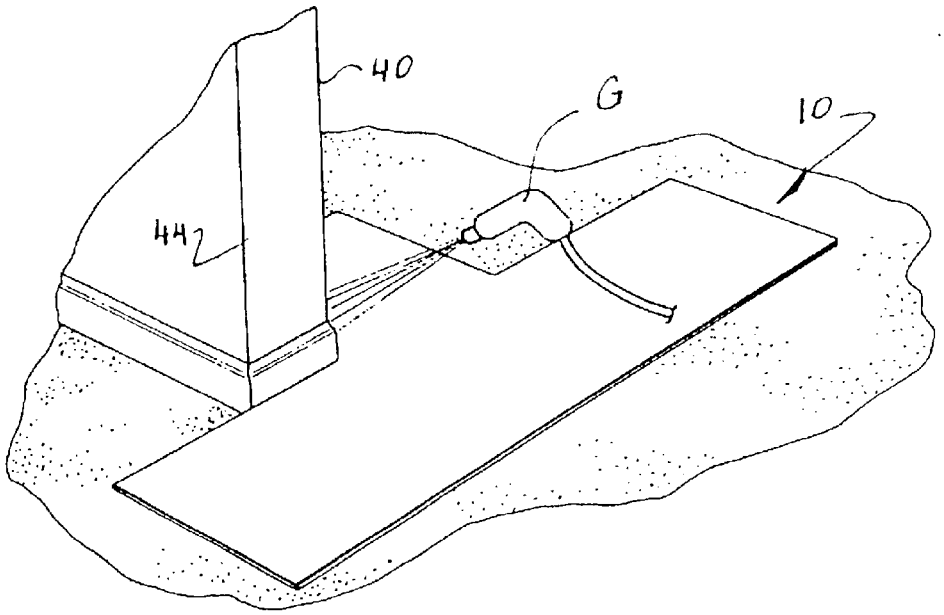
FIG. 3 is a perspective view of a paint shield constructed in accordance with the present invention, in use with an outside corner of a wall surface.

FIG. 3 illustrates shield 10 being used for painting an outside corner 40 of a wall. In this illustration, the painter would likely grasp major portion 12, perhaps along straight edge 34, and force right-hand outside corner shield 42 against corner 40. The other corner 44 illustrated in FIG. 3 could then be painted simply by rotating paint shield 10 generally ninety degrees such that corner 44 is received within outside corner shield 42.

Because of the design of the paint shield 10 of the present invention, and its lightweight and flexible nature, it can be grasped in numerous positions and resiliently deformed in order to meet a number of shielding needs.

Figure 5:
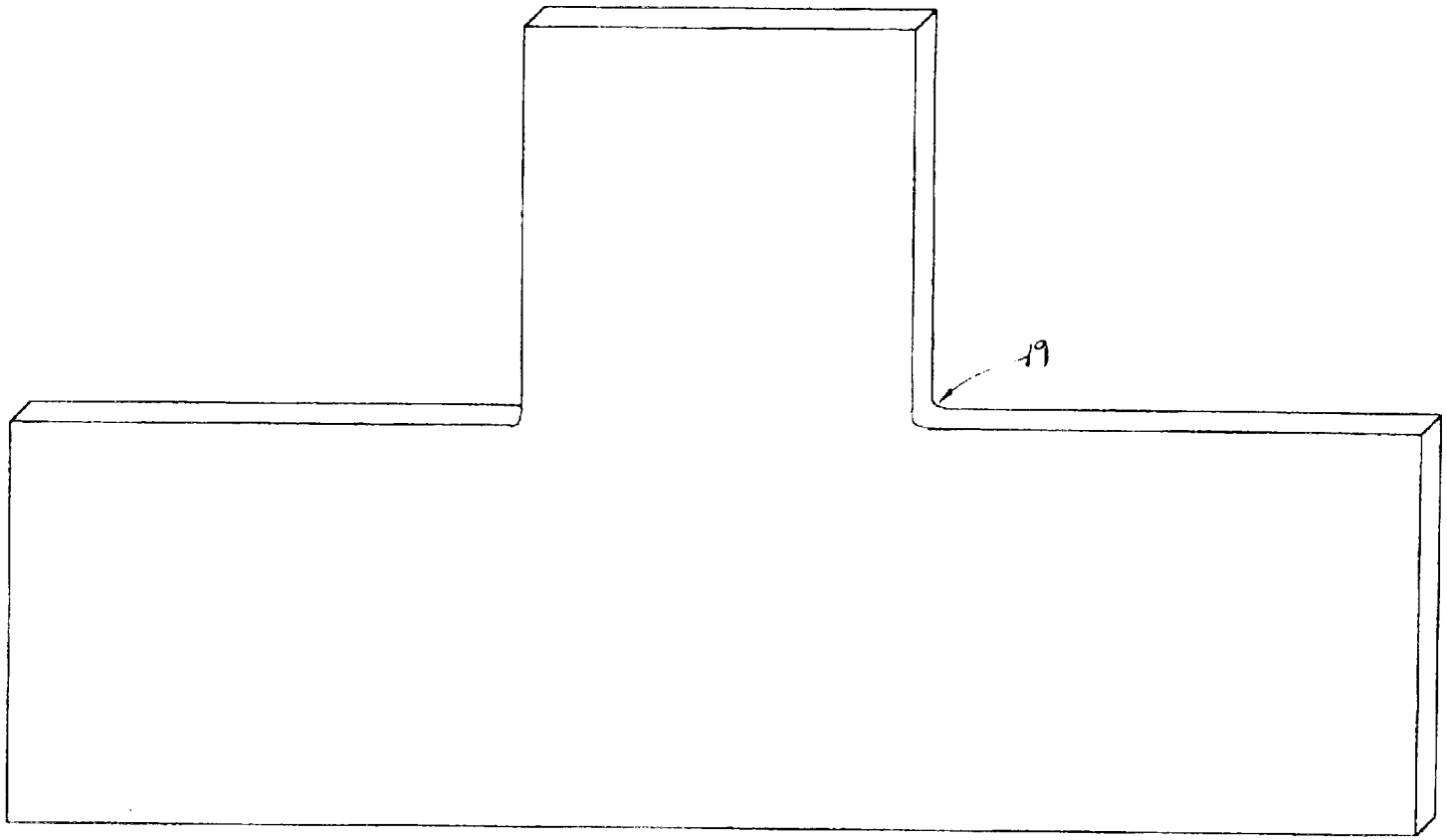
FIG. 5 is another perspective view of a paint shield constructed in accordance with the present invention.

Paint shield 10 is relatively large. As noted above, edge 34 is, in one preferred embodiment, approximately thirty-six inches (36") long. Edges 30 and 48 are approximately ten inches (10"), and the sides 50, 52 and end 54 of secondary portion 14 are also approximately ten inches (10"), with secondary portion 14 preferably being centered along major portion 12, as shown in FIG. 5. However, because of the flexibility of shield 10, the effective length of the sides is variable in that one or more of the ends of an edge can be bent up (or down) to shorten, and thus reduce, the effective length of the sides as necessary.

Because of the sheer size of paint shield 10, it provides sufficient surface area for use in spray painting operations where there will tend to be more splatter and over spray, and thus more risk of paint being found on surfaces or objects which should not receive paint, as compared to application of paint with a brush. It is to be understood, however, that paint shield 10 could also be used in applications where paint is being applied by brush. However, it paint shield 10 is to be used solely as a shield for painting by brush, the size of the shield may be varied, and perhaps made smaller, if desired. It is also to be understood that the dimensions of paint shield 10 set forth herein are for example purpose only, and paint shield 10 could be made in variety of other configurations. For example, although not shown, paint shield 10 could be made in a generally L-shape, instead of the T-shape version as shown in the drawings. Furthermore, although not shown, paint shield 10 could be formed as simply a straight member. For example, secondary portion 14 could be removed altogether from major portion 12, thereby leaving only major portion 12 as a paint shield.

In addition to outside corner shields 28, 42, shield 10 includes six inside corner shields 31, 33, 35, 37, 39 and 41 which allow for shield 10 to be positioned in a number of orientations as needed for painting inside corners.

An advantage of paint shield 10 is that it is easily washable, and if, for example, latex paint is being used, can be readily washed with water and then immediately put back in service. Paint shield 10 is also versatile in that it can be used for painting walls, floors, cabinets, trim, and in numerous other painting applications.

Because of the lightweight and low profile nature of paint shield 10, the painter can easily flip shield 10 one way or the other to provide the proper shielding needed by the painter. If the painter is painting a corner, as discussed above with regard to FIG. 3, and then needed to paint another corner, shield 10 could simply be slid and/or rotated to the next corner without being flipped over. This is important since the shield 10 may have paint on the upper surface, and this allows shield 10 to continue to be used without having to first clean shield 10 in order to accommodate the next corner.

In operation, paint shield 10 would be used to paint a surface by using one or more of the edges 30, 34, 48, 49, 50, 52, 53, 54 which would be placed against the surface and paint then applied by brushing or preferably by spraying upon that portion of the surface adjacent the edge or edges. If an inside corner, such as shown in FIG. 4, is to be painted, one of the inside corner shields 31, 33, 35, 37, 39, 41 would be inserted into the corner and paint applied. If there was insufficient wall space to lay shield 10 flat in order to paint such inside corner, due, for example, to corner 18' in FIG. 4, then shield 10 could be depressed firmly along a mid-portion into the corner such that paint may be applied as close to the corner as possible. Then, shield 10 would be removed and rotated such that an edge could then be inserted into the corner, and painting of the corner completed.

If an outside corner is to be painted, such as shown in FIG. 3, one of the outside corner shields would simply be placed against such corner and paint then applied.

Paint shield 10 finds particular application in repainting, or recoating, applications, such as when apartments are repainted between tenants. In such a situation, shield 10 can first be used for applying a paint to the trim surfaces, such as a gloss or semi-gloss paint, wherein the floor surface would be shielded from paint. Then, in painting the wall surfaces above the trim, shield 10 would be used to shield the trim from the wall paint, which could be flat, or have different gloss characteristics than the trim, and/or which could be of a different color than the trim.

Another feature of shield 10 is that because of its flexible, planar shape, it is easy to transport and store. It can be rolled up or it can be bent in order to fit into a storage position for transport, as necessary. Because of the material preferably used for constructing shield 10, namely HDPE, shield 10 is non-marring and non-scarring, which reduces the likelihood of damage to surfaces during painting. Further, because of the thin profile of shield 10, it can also easily be slid under doors, or into other crevices, as necessary, for shielding during painting. Additionally, the smooth, generally slick surface of shield 10 allows the shield to easily slide along a floor or wall during painting, with minimal frictional resistance.

Accordingly, the present invention provides a paint shield which is lightweight and relatively simply to manufacture, and which is durable and easy to use.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the present disclosure.

What is claimed is:

1. A paint shield for shielding paint from selected surfaces adjacent walls and wall inside and outside corners, comprising:

a first sheet member extending generally longitudinally and a second sheet member connected to and extending generally transverse with respect to said first sheet member, such that said first and second sheet members together generally form a generally T-shaped structure;

said first and said second sheet members being formed of a flexible material;

said T-shaped structure including at least seven straight edges for shielding paint from selected surfaces adjacent walls;

said T-shaped structure including at least five inside corner shields for shielding paint from selected surfaces adjacent wall inside corners; and said T-shaped structure including at least one outside corner shield for shielding paint from selected surfaces adjacent a wall outside corner, said outside corner shield having a radiused profile for engaging the wall outside corner.

2. The paint shield as defined in claim 1, wherein said flexible plastic is high density polyethylene.

3. The paint shield as defined in claim 1, wherein said flexible material is high density polyethylene.

4. The paint shield as defined in claim 1, wherein said T-shaped structure is flexible and configured to be bent through an angle at least 90 degrees.

5. The paint shield as defined in claim 1, wherein said T-shaped structure is flexible and configured to be rolled up into a generally cylindrical configuration.

6. The paint shield as defined in claim 1, wherein said T-shaped structure has a top surface and a bottom surface, and wherein said top and bottom surfaces have a slick surface finish.

7. The paint shield as defined in claim 1, wherein said first sheet member is flexible and configured to be bent through an angle of at least 90 degrees.

8. The paint shield as defined in claim 1, wherein said T-shaped structure is flexible and configured to be bent through an angle of at least 90 degrees.

9. The paint shield as defined in claim 1, wherein said T-shaped structure is flexible and configured to be bendable for shortening the effective length of said first sheet member.

10. The paint shield as defined in claim 1, wherein said T-shaped structure is flexible and configured to be bendable for shortening the effective length of said second sheet member.

11. The paint shield as defined in claim 1, wherein the thickness of each of said first and second sheet members is between 3/32 and 1/8 inches.

12. The paint shield as defined in claim 1, wherein said first sheet member is approximately 36 inches in length.

13. The paint shield as defined in claim 1, wherein said second sheer member is approximately 10 inches in width.

14. The paint shield as defined in claim 1, wherein said first sheet member is approximately 10 inches wide and 36 inches long and wherein said second sheet member is approximately 10 inches long and 10 inches wide.

15. A paint shield for shielding paint sprayed from a paint sprayer from selected surfaces adjacent walls and wall inside and outside corners, the paint shield comprising:

a first sheet member extending generally longitudinally and a second sheet member connected to and extending generally transverse with respect to said first sheet member, such that said first and second sheet members together generally form a T-shaped structure;

said first and said second sheet members being formed of high density polyethylene, said T-shaped structure being flexible and configured to bendable through an angle range of at least 90 degrees;

said T-shaped structure including at least seven straight edges for shielding paint from selected surfaces adjacent a wall;

said T-shaped structure including at last five inside corner shields for shielding paint from selected surfaces adjacent inside corners; and said T-shaped structure including at least one outside corner shield for shielding paint from selected surfaces adjacent outside corners, said outside corner shield having a radiused profile for engaging the outside corners.

* * * * *

UNITED STATES PATENT AND TRADEMARK OFFICE

CERTIFICATE OF CORRECTION

PATENT NO. : 6,808,794 B1
DATED : October 26, 2004
INVENTOR(S) : Kerry Mattox

It is certified that error appears in the above-identified patent and that said Letters Patent is hereby corrected as shown below:

Column 3,
Line 51, “1B” should be -- 18 --.

Column 4,
Line 16, the word “it” should be -- if. --

Signed and Sealed this

Twenty-second Day of February, 2005

JON W. DUDAS
*Director of the United States Patent and Trademark Office*